US007598886B2

(12) United States Patent
Hall et al.

(10) Patent No.: US 7,598,886 B2
(45) Date of Patent: Oct. 6, 2009

(54) SYSTEM AND METHOD FOR WIRELESSLY COMMUNICATING WITH A DOWNHOLE DRILL STRING

(76) Inventors: David R. Hall, 2185 S. Larsen Pkwy., Provo, UT (US) 84606; Christopher Durrand, 2185 S. Larsen Pkwy., Provo, UT (US) 84606; Paula Turner, 2185 S. Larsen Pkwy., Provo, UT (US) 84606; Joe Fox, 2185 S. Larsen Pkwy., Provo, UT (US) 84606

( * ) Notice: Subject to any disclaimer, the term of this patent is extended or adjusted under 35 U.S.C. 154(b) by 694 days.

(21) Appl. No.: 11/379,729

(22) Filed: Apr. 21, 2006

(65) Prior Publication Data

US 2007/0257811 A1 Nov. 8, 2007

(51) Int. Cl.
*G01V 1/00* (2006.01)

(52) U.S. Cl. ..... 340/854.6; 340/854.4; 175/50; 367/82

(58) Field of Classification Search ..... 340/853.1, 340/854.4, 854.6; 367/82; 175/27, 50
See application file for complete search history.

(56) References Cited

U.S. PATENT DOCUMENTS 3,876,972 A * 4/1975 Garrett ..... 367/82
3,967,201 A 6/1976 Rorden
4,416,494 A 11/1983 Watkins
4,788,544 A * 11/1988 Howard ..... 340/853.7
6,392,317 B1 5/2002 Hall
6,670,880 B1 12/2003 Hall
6,717,501 B2 4/2004 Hall
6,799,632 B2 10/2004 Hall
6,821,147 B1 11/2004 Hall
6,830,467 B2 12/2004 Hall
6,844,498 B2 1/2005 Hall
6,888,473 B1 5/2005 Hall
6,913,093 B2 7/2005 Hall
6,929,493 B2 8/2005 Hall
6,945,802 B2 9/2005 Hall
6,968,611 B2 11/2005 Hall
2001/0029780 A1 * 10/2001 Bartel ..... 73/152.03
2004/0104797 A1 6/2004 Hall
2004/0113808 A1 6/2004 Hall
2004/0145492 A1 7/2004 Hall
2004/0150532 A1 8/2004 Hall
2004/0164833 A1 8/2004 Hall
2004/0164838 A1 8/2004 Hall
2004/0216847 A1 11/2004 Hall
2004/0244916 A1 12/2004 Hall (Continued)

*Primary Examiner*—Timothy Edwards, Jr.
(74) *Attorney, Agent, or Firm*—Tyson J. Wilde; Daniel P. Nelson

(57) ABSTRACT

A system for communicating with a downhole network integrated into a downhole drill string is disclosed in one aspect of the invention as including a data transmission coupler mounted to a downhole tool and adapted to transmit data across a tool joint. The data transmission coupler is also capable of transmitting data by emitting electromagnetic radiation. An antenna is focused at and positioned within sufficient range of the data transmission coupler to detect the electromagnetic radiation and receive the data. This data may then be transmitted to a receiver or other equipment. In certain embodiments, the antenna is located above ground level and may be mounted to a swivel, derrick, hoist system, kelly, or other structure. The antenna is ideally mounted to a structure which is out of the way of equipment and workers working on the drill string.

9 Claims, 7 Drawing Sheets

U.S. PATENT DOCUMENTS

2004/0244964 A1 12/2004 Hall
2004/0246142 A1 12/2004 Hall
2005/0001735 A1 1/2005 Hall
2005/0001736 A1 1/2005 Hall
2005/0001738 A1 1/2005 Hall
2005/0035874 A1 2/2005 Hall
2005/0035875 A1 2/2005 Hall
2005/0035876 A1 2/2005 Hall
2005/0036507 A1 2/2005 Hall
2005/0039912 A1 2/2005 Hall
2005/0045339 A1 3/2005 Hall
2005/0046586 A1 3/2005 Hall
2005/0046590 A1 3/2005 Hall
2005/0067159 A1 3/2005 Hall
2005/0070144 A1 3/2005 Hall
2005/0082092 A1 4/2005 Hall
2005/0092499 A1 5/2005 Hall
2005/0093296 A1 5/2005 Hall
2005/0095827 A1 5/2005 Hall
2005/0115717 A1 6/2005 Hall
2005/0145406 A1 7/2005 Hall
2005/0150653 A1 7/2005 Hall
2005/0161215 A1 7/2005 Hall
2005/0173128 A1 8/2005 Hall
2005/0212530 A1 9/2005 Hall
2005/0236160 A1 10/2005 Hall
2005/0284662 A1 12/2005 Hall

* cited by examiner

SYSTEM AND METHOD FOR WIRELESSLY COMMUNICATING WITH A DOWNHOLE DRILL STRING

BACKGROUND OF THE INVENTION

1. Field of the Invention

The present invention relates to systems and methods for communicating with a drill string and more particularly to systems and methods for communicating with a drill string data network when a drill string is not actively drilling.

2. Background

The oil drilling industry has long sought to retrieve downhole information more reliably and at faster rates while drilling. For example, U.S. Pat. No. 6,670,880, issued to Hall et al., discloses a downhole transmission system that transmits data by way of a transmission system integrated into a drill string. This transmission system utilizes data transmission couplers installed in the ends of downhole tools to transmit data across the tool joints. Data is transmitted to the data transmission couplers by way of a cable or other transmission line routed through each downhole tool.

During drilling, a rotary connector may be used to enable communication between the Hall transmission system and surface equipment. In certain cases, the rotary connector may be used in place of a saver sub. Like a saver sub, the rotary connector is inserted between the threaded portion of the top drive or kelly and the drill string and may save the threads of the top drive or kelly from excessive wear. During tripping or other operations, the rotary connector is typically disconnected from the drill string, which severs communication between surface equipment and the drill string. Thus, data cannot be uploaded to or downloaded from the drill string during this time period.

In general, the term "tripping" refers to a set of operations performed to remove and/or replace an entire drill string or a portion thereof from a borehole. For example, tripping is necessary for a number of well operations that change the configuration of a bottom-hole assembly, such as replacing a bit or another tool, adding a mud motor, or adding measurement while drilling (MWD) or logging while drilling (LWD) tools, reaching the casing point, or running a wireline tool. Tripping can take many hours if downhole tools are to be brought to the surface, depending on the depth to which drilling has progressed.

The ability to maintain communication with downhole tools and instruments during tripping can enable a wide variety of MWD and LWD measurements to be taken during time that might otherwise be wasted. This ability can also enhance safety. For example, in the event that a pocket of high-pressure gas breaks through into a well bore, the crew can be given critical advance warning of a dangerous "kick," and timely action can be taken to protect the crew and save the well. Maintaining communication during tripping can also give timely warning of lost circulation or other potential problems, enabling timely corrective action, which can save time and money.

In view of the foregoing, what is needed is a system and method for communicating with a drill string during tripping or other periods of drilling inactivity. Such a system and method would ideally maintain communication between a drill string and surface equipment even when a direct connection with the drill string transmission system is broken or interrupted. Furthermore, such a system and method would ideally be simple and not interfere with rig floor activities, tripping or other activities around or near the drill string.

SUMMARY OF THE INVENTION

Consistent with the foregoing, and in accordance with the invention as embodied and broadly described herein, a system for communicating with a downhole network integrated into a downhole drill string is disclosed in one aspect of the invention as including a data transmission coupler mounted to a downhole tool and adapted to transmit data across a tool joint. The data transmission coupler is also capable of transmitting data by emitting electromagnetic radiation. An antenna is focused at and positioned within sufficient range of the data transmission coupler to detect the electromagnetic radiation and receive the data. This data may then be transmitted to a receiver or other equipment. In other embodiments, the antenna is capable of transmitting signals to the data transmission coupler located in the downhole tool.

In certain embodiments, the antenna is located above ground level and may be mounted to a swivel, derrick, hoist system, kelly, or other structure. The antenna is ideally mounted to a structure which is out of the way of equipment and workers who may be tripping or working on the drill string. A suitable antenna for communicating with the data transmission coupler may include, among others, a dipole antenna, a loop antenna, a magnetic loop antenna, segmented antenna, or variations thereof. However, in order to be able to detect the electromagnetic radiation from the data transmission coupler, the antenna is ideally positioned within one to two hundred feet from the data transmission coupler. In certain embodiments, in the event the radiation is weak or misaligned with the antenna, the system may include a reflection mechanism, such as a dish, horn, waveguide, or the like, to direct the electromagnetic radiation to the antenna.

A data transmission coupler suitable for emitting electromagnetic radiation and transmitting data across a tool joint may include, for example, an inductive and a direct contact coupler. The data transmission coupler may be located on the primary shoulder, the secondary shoulder, the threadform of a downhole tool, or the like. In certain embodiments, the data transmission coupler exhibits a positive gain in the axial direction of the downhole tool when emitting electromagnetic waves.

In another aspect of the invention, a method for communicating with a downhole network integrated into a drill string includes halting rotation of a drill string equipped with data transmission couplers for transmitting data across the tool joints. The method then includes exposing an uppermost data transmission coupler of the uppermost downhole tool of the drill string and wirelessly communicating with the data transmission coupler. In certain embodiments, wireless communicating includes communicating with the uppermost data transmission coupler with an antenna located above ground level.

BRIEF DESCRIPTION OF THE DRAWINGS

In order to describe the manner in which the above-recited features and advantages of the present invention are obtained, a more particular description of apparatus and methods in accordance with the invention will be rendered by reference to specific embodiments thereof, which are illustrated in the appended drawings. Understanding that these drawings depict only typical embodiments of the present invention and are not, therefore, to be considered as limiting the scope of the invention, apparatus and methods in accordance with the present invention will be described and explained with additional specificity and detail through the use of the accompanying drawings in which.

DETAILED DESCRIPTION OF THE INVENTION

It will be readily understood that the components of the present invention, as generally described and illustrated in the Figures herein, could be arranged and designed in a wide variety of different configurations. Thus, the following more detailed description of the embodiments of systems and methods in accordance with the present invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
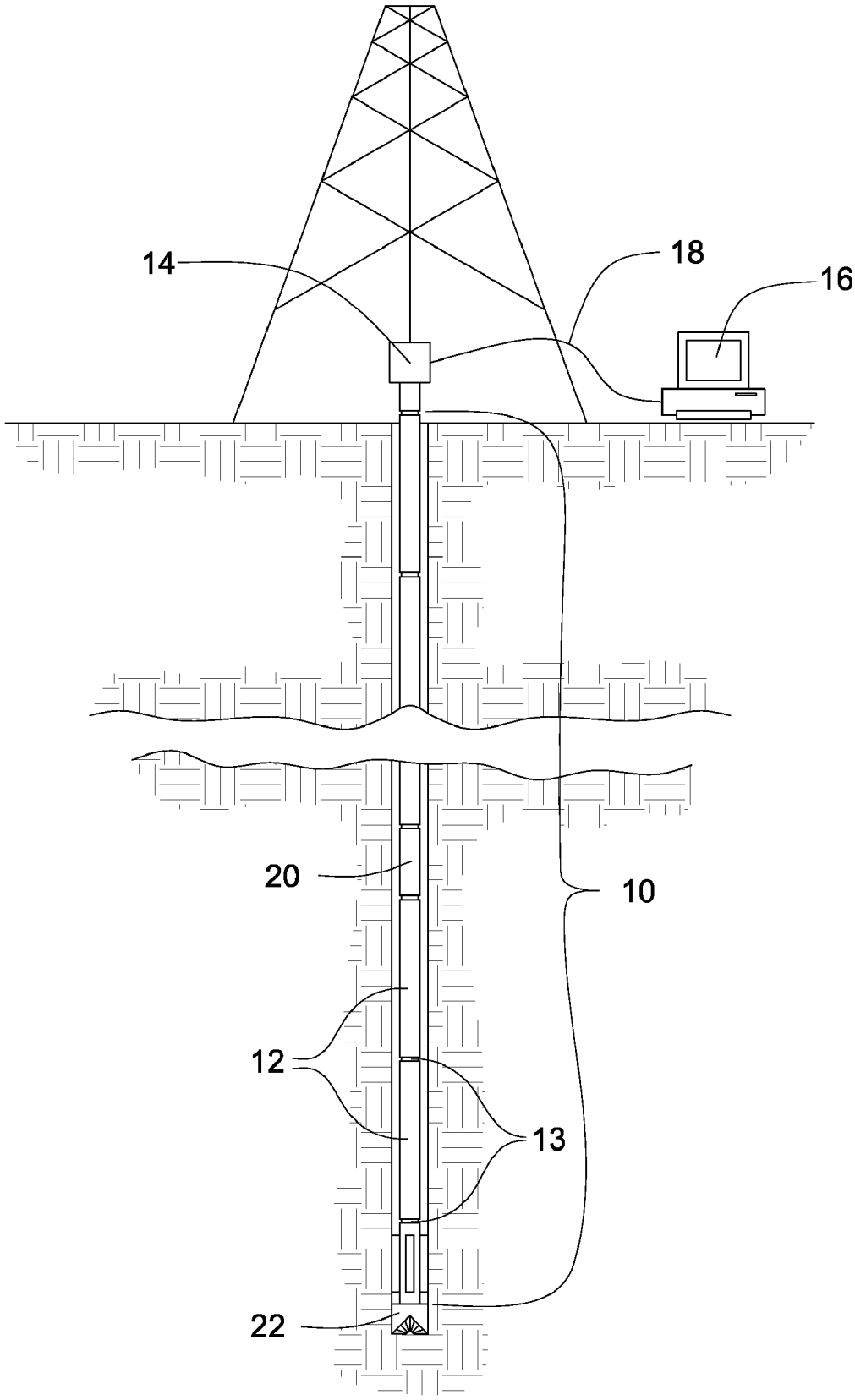
FIG. 1 is a high-level elevation view of a drill string network communicating with surface equipment by way of a hard-wired connection.

Referring to FIG. 1, as previously mentioned, Hall (U.S. Pat. No. 6,670,880) discloses one embodiment of a system for transmitting data along a drill string 10. In that patent, data transmission couplers are mounted in the secondary shoulders of downhole tools 12 to transmit data across the tool joints 13. Data is transmitted between the data transmission couplers using cable or other transmission media routed through each downhole tool 12.

In U.S. Patent Application No. 20050046586 filed on Mar. 3, 2005, Hall further discloses a "swivel assembly" 14 (or rotary connector 14) to extract data from the drill string 10 and provide a connection between the drill string 10 and surface equipment 16. In one embodiment, the swivel assembly 14 employs a physical conductor 18 or other media 18 to communicate with the drill string 10. Hall also suggests using a wireless transceiver in the swivel assembly 14 in certain situations, such as in wet environments or where electrical signals may be hazardous due to creation of an ignition source. In any event, the swivel assembly 14 disclosed by Hall provides the primary interface between the drill string 10 and surface equipment 16 during drilling operations.

Certain situations, however, may require removal of the swivel assembly 14. For example, the swivel assembly 14 may be temporarily removed when tripping the drill string 10 in and out of the borehole 20. This may be necessary to change a drill bit 22 or other component of a drill string 10, conduct certain tests in the borehole 20, run casing, or perform a completion operation or other activity. In some cases the drill string may simply rest in the slips, like in situations when the top-hole equipment needs to be repaired. In other cases, a physical cable 18 or line 18 may interfere with certain drilling operations and thereby require removal.

During these time periods, which may be lengthy, communication may be lost between surface equipment 16 and the drill string 10. This may prevent taking a wide variety of MWD and LWD measurements when a drill string 10 is inactive or is lifted from a borehole 20. This may also limit the ability to detect and warn of hazardous events, such as dangerous kicks caused by pockets of high-pressure gas breaking into a well bore 20. This, in turn, may limit the ability to take timely corrective action. Thus, apparatus and methods are needed to communicate with a drill string 10 when a swivel assembly 14 or other connection 14 is disconnected from the drill string 10.

Figure 2:
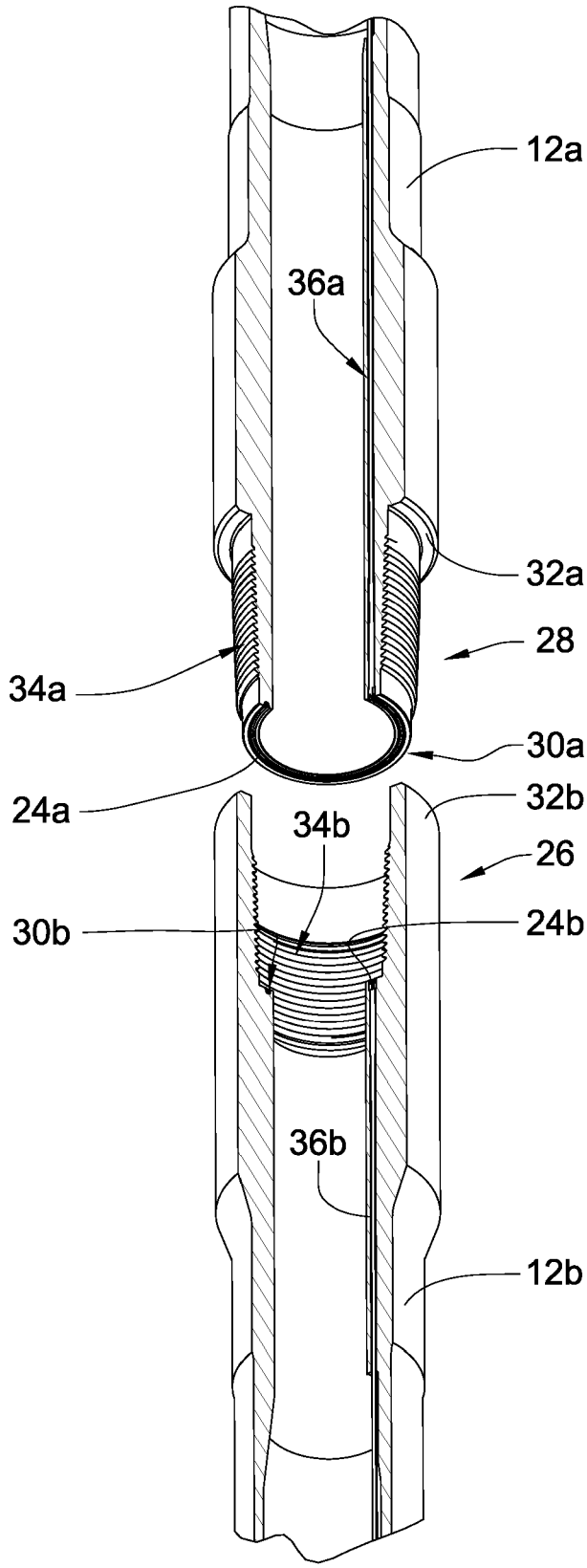
FIG. 2 is a cutaway perspective view of one embodiment of downhole tools using data transmission couplers for communicating across a tool joint.

Referring to FIG. 2, as previously mentioned, data transmission couplers 24*a*, 24*b* may be mounted in the box end 26 and pin end 28 of downhole tools 12*a*, 12*b* to transmit data across a tool joint. For the purposes of this specification, the phrase "downhole tool" is used to encompass a wide variety of downhole components, including but not limited to drill pipe, drill collars, stabilizers, hole openers, sub-assemblies, under-reamers, rotary-steerable systems, drilling jars, drilling shock absorbers, LWD tools, MWD tools and the like, to name just a few.

Likewise, the phrase "data transmission coupler" is used generically to mean a component, mounted to a downhole tool, adapted to contact or come into close proximity to another data transmission coupler, mounted to another downhole tool, upon connecting the downhole tools together. The couplers are adapted to transmit, or "couple," a data-bearing signal from one coupler to the other. Ideally, the data transmission coupler minimizes power loss as the signal is transmitted across the tool joint to minimize signal attenuation and to increase the distance the signal may travel before requiring regeneration or amplification.

In certain embodiments, data transmission couplers 24*a*, 24*b* may transmit a signal by induction. That is, a first data transmission coupler 24*b* may convert a data-bearing electrical signal to a data-bearing magnetic field. A second data transmission coupler 24*a* is "coupled" to the magnetic field and converts the field back to an electrical signal, thereby substantially replicating the first electrical signal. Data transmission couplers 24*a*, 24*b* functioning under this principle are disclosed, for example, in published U.S. Patent Publication No. 2004-0164838 and published U.S. Patent Publication No. 2005-0001738, having common inventors with the present invention.

In other embodiments, the data transmission couplers 24*a*, 24*b* may transmit data through direct electrical contact. That is, a conductive terminal on a first data transmission coupler 24*b* contacts and transmits electrical current to a conductive terminal on a second data transmission coupler 24*a*. Data transmission couplers 24*a*, 24*b* functioning under this principle are disclosed, for example, in published U.S. Patent Publication No. 2005-0001738 and published U.S. Patent Publication No. 2005-0074988, having common inventors with the present invention.

As illustrated, data transmission couplers 24*a*, 24*b* may be mounted in the secondary shoulders 30*a*, 30*b* of the pin end 28 and box end 26 of the downhole tools 12*a*, 12*b*. Upon threading a first downhole tool 12*a* into a second downhole tool 12*b*, the data transmission couplers 24*a*, 24*b* come into contact, or close proximity, to one another, thereby enabling transmission of a signal from one coupler to the other. By installing the data transmission couplers 24*a*, 24*b* in the secondary shoulders 30*a*, 30*b* of the tools 12*a*, 12*b*, the couplers 24*a*, 24*b* may achieve greater protection than they would if installed in the primary shoulders 32*a*, 32*b* of the tools 12*a*, 12*b*.

Nevertheless, in certain embodiments, data transmission couplers 24*a*, 24*b* may also be installed on the primary shoulders 32*a*, 32*b* or even in the threadform 34*a*, 34*b* of the downhole tools 12*a*, 12*b*. Cables 36*a*, 36*b* or other transmission media 36*a*, 36*b* may connect to the data transmission couplers 24*a*, 24*b* to transmit signals between the data transmission couplers 24*a*, 24*b* along the downhole tools 12*a*, 12*b*.

In certain embodiments, the data transmission couplers 24*a*, 24*b*, in addition to their primary function of transmitting data across a tool joint, may radiate data signals in the form of electromagnetic waves. That is, a data transmission coupler 24 may inherently, or by design, function as an antenna. For example, in the event a data transmission coupler 24 is exposed to open air, such as might occur during tripping operations when a downhole tool 12 is the uppermost downhole tool 12 in a drill string 10, the data transmission coupler 24 may radiate a signal by emitting electromagnetic waves. Assuming a receiving antenna is positioned within range to detect this electromagnetic radiation, the waves may be received and the data demodulated. The data may then be stored, analyzed, processed, or combinations thereof In other embodiments, the processed may be reversed where signals to be transmitted by the antenna are demodulated before transmission and are stored, analyzed, and/or processed after being received by the downhole tool.

Figure 3:
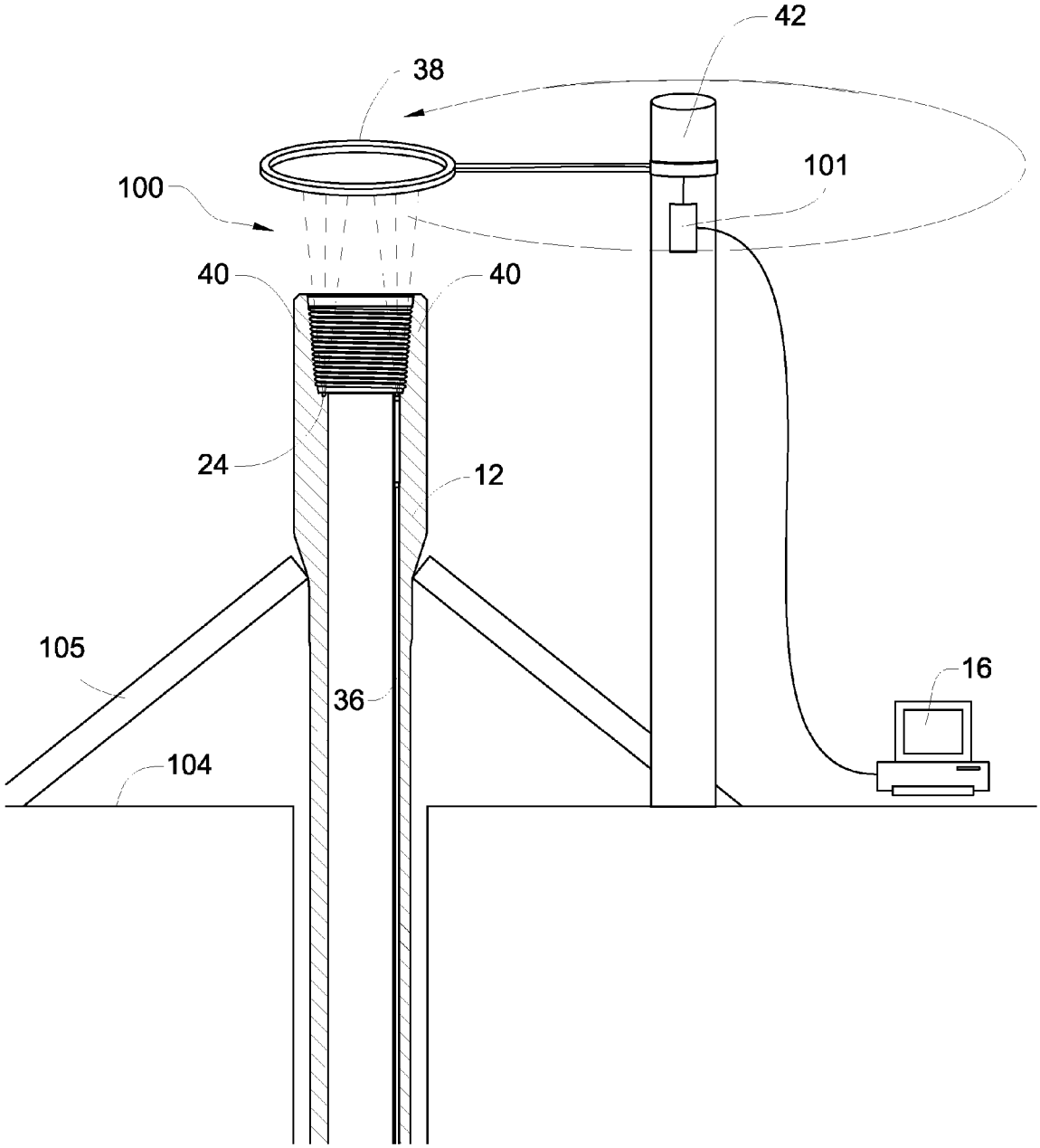
FIG. 3 is a cross-sectional elevation view of an antenna wirelessly communicating with a data transmission coupler.

Referring to FIG. 3, in certain embodiments, an antenna 38 may be used to communicate with a data transmission coupler 24 in the event a data transmission coupler 24 is exposed on the open end 100 of a downhole tool 12, such as might occur during tripping operations. The downhole tool 12 may be suspended at the rig floor 104 by slips 105 during tripping or other operations. In certain embodiments, the metallic walls 40 of the open end 100 may effect the electromagnetic waves radiated by the coupler 24, the antenna 38 may be positioned sufficiently over the open end of the downhole tool 12 (i.e., in the axial direction of the downhole tool 12). To hold the antenna in place, the antenna 38 may be mounted to a structure 42, such as a derrick, swivel, kelly, hoist system, or other structure. Likewise, the antenna 38 may interface with surface equipment 16, such as a computer, storage device, server, communications system, or the like.

The selected size, position, and design of the antenna 38 may depend, at least in part, on the signal strength radiated by the data transmission coupler 24 and may also depend on the design and construction of the rig. In certain embodiments, the antenna 38 is designed to function based on the weakest signal strength it will encounter. This signal strength will depend in large part on the distance between the data transmission coupler 24 and a transmitting node or other transceiver located along the drill string 10.

For example, as explained in U.S. patent application Ser. No. 10/710,790, having common inventors with the present invention, network nodes may be positioned at various intervals along the drill string to act as repeaters for signals traveling up and down the drill string. As the signal travels along the drill string 10 (as shown in FIG. 1) between the nodes, the signal attenuates and loses power. Thus, signal strength may depend on factors such as the distance between the data transmission coupler 24 and a downhole node or receiver, the amount of signal attenuation occurring in the transmission line 36 or other data transmission couplers, and the like.

Signal strength radiated by the coupler 24 may also depend on the efficiency of the data transmission coupler 24 to act as an antenna, the gain of the data transmission coupler 24 in the direction of the antenna 38, the resonant frequency of the data transmission coupler 24, the bandwidth of the data transmission coupler 24, any impedance in the data transmission coupler 24, and the like. Each of these factors may also apply to the receiving antenna 38 and its ability to detect the incoming electromagnetic waves. The above-mentioned factors may determine the type, size, and location of the antenna 38. Ideally, the antenna 38 is located within one to two hundred feet of the data transmission coupler 24.

Electronic equipment 101 may be situated adjacent and in electrical communication with the antenna 38 which may be used to modify the signals received by the antenna. For example, the electronic equipment may repeat or amplify the weak signals, or it may convert analog signals to digital signals or vice versa. The electronic equipment may comprise circuitry adapted to check errors, compress data, adjust data rate, filter frequencies or combinations thereof.

Although generically depicted as a loop antenna in FIG. 3, an antenna 38 in accordance with the invention may be selected from various types of antennas. For example, in certain embodiments the antenna 38 may be a dipole antenna, a loop antenna, a magnetic loop antenna, or variations thereof, including phased arrays of these antennas. Variations of a dipole antenna may include, for example a whip, J-pole, Yagi-Uda, folded dipole, or "rabbit ears" antenna. Variations of a loop antenna may include, for example, a delta loop or quad antenna.

In certain embodiments, a magnetic loop antenna may be used to detect the magnetic component of electromagnetic waves emitted by the data transmission coupler 24. This type of antenna may be very efficient in relation to its size and may be effective at rejecting noise generated by other radio sources. To adjust its frequency of operation, a capacitor may be provided to tune the magnetic loop antenna to a desired frequency.

In certain embodiments, communication between the data transmission coupler 24 and the antenna 38 may be exclusively or substantially unidirectional. That is, data may flow from the data transmission coupler 24 to the antenna 38 but not vice versa. This is because the data transmission coupler 24, although suitable for transmitting data, may be unable, either inherently or by design, to receive and convert electromagnetic waves to a suitable signal with enough power for transmission along the drill string 10. However, in some embodiments of the present invention, the antenna is capable of bi-directional communication with the downhole tool.

In cases, a connectionless protocol may be used to transmit data between the data transmission coupler 24 and the antenna 38. Such a protocol may include, for example, the Internet Protocol (IP), User Datagram Protocol (UDP), or a protocol functioning under a similar principle. This may eliminate the need for handshaking or other prior arrangements typical of connection-oriented protocols. Although potentially less reliable, use of a connectionless protocol may eliminate the need to transmit signals downhole. In certain embodiments, the drill string network may periodically transmit data uphole using a connectionless protocol for download by the antenna 38. This periodic transmission may occur during tripping or other operations when a swivel assembly 14 or other rotary connector 14 is disconnected. Another protocol may be used when the rotary connector keeps the drill string in data communication with the surface equipment, but the protocols may automatically switch when the rotary connector is disconnected. The downhole tools may be equipped with clock sources and other devices that may operate under both protocols.

In certain embodiments, bandwidth for communications between the data transmission coupler 24 and the antenna 38 may be limited or diminished relative to bandwidth of the drill string network. The bandwidth may depend on the signal strength radiated by the data transmission coupler 24, the design of the antenna 38 or data transmission coupler 24, frequencies utilized, or the like. To adjust for this diminished bandwidth, in certain embodiments, only certain types of data may be transmitted to the antenna 38. In other embodiments, extraneous, cumulative, redundant, or unimportant information may be filtered out prior to being transmitted to the antenna 38.

In certain embodiments, data transmitted between the data transmission coupler 24 and the antenna 38 may provide a primary means of downloading data during tripping operations or other periods of drilling inactivity. In other embodiments, this system may work in conjunction with a mud pulse or EM (electromagnetic) telemetry system to download data from the drill string 10. In yet other embodiments, the system disclosed in FIG. 3 may simply provide a backup system to a mud pulse or EM telemetry system or may simply be used under certain conditions or circumstances.

As with most antennas, a data transmission coupler 24 may exhibit a positive gain in some directions. Similarly, due to the shielding effect of the downhole tool walls 40, the radiation pattern emitted by the coupler 24 may be quite narrow (i.e., propagating in the axial direction of the downhole tool 12). Thus, an antenna 38 may in certain circumstances require fairly accurate placement relative to the downhole tool to ensure the antenna 38 will be able to detect radiation emitted by the coupler 24. That is, slight misalignment of either the downhole tool 12 or the antenna 38 may impair communication between the coupler 24 and the antenna 38.

In certain embodiments, to remedy misalignment or improve communication between the antenna 38 and the coupler 24, the antenna 38 may incorporate a reflection mechanism 102, such as a dish, feed horn, waveguide, or other reflector to direct electromagnetic waves to the antenna 38. In other embodiment, multiple antennas 38 may be mounted above the coupler 12 to detect electromagnetic for various different alignments of the coupler 24. Similarly, in other embodiments simply moving an antenna 38 closer to the coupler 24 may reduce the negative effect of misalignment.

As in the embodiment of FIG. 3, the antenna may be pivotally mounted or slideable mounted to the structure 42, such that the antenna 38 may be moved out of the way of tripping or other operations when the wireless communication is unnecessary or no longer desired. The movement of the antenna may be automatic and controlled by an executable code which is places the antenna within a receiving range during certain steps in the operation. In other embodiments, the antenna may be manually positioned.

Figure 4:
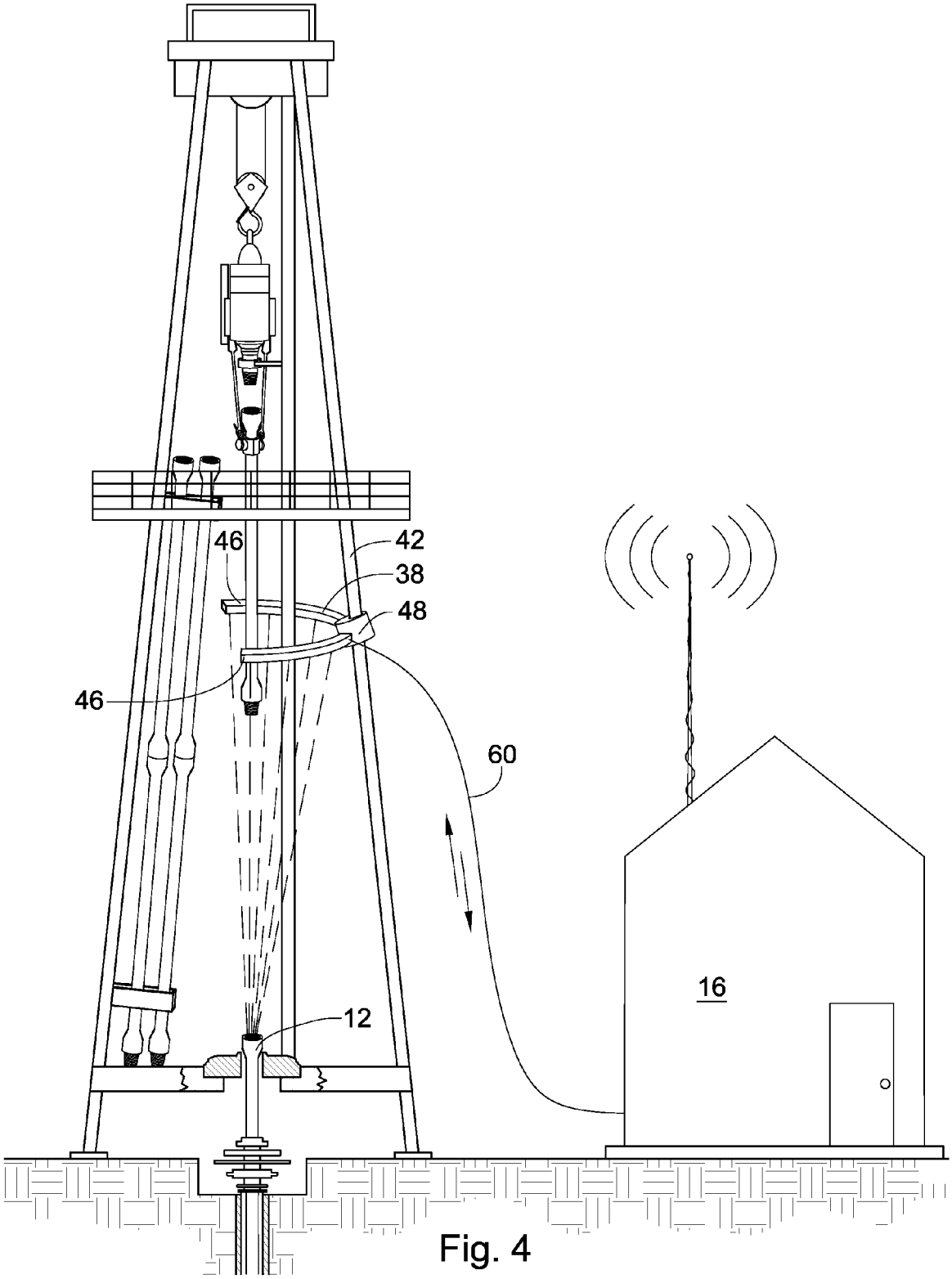
FIG. 4 is an elevation view of one embodiment of an antenna for wirelessly communicating with a data transmission coupler.

Referring to FIG. 4, in certain embodiments, an antenna 38 may be rigidly mounted to a structure 42, such as a derrick 42. For example, an antenna 38 may include a dipole antenna 38, employing two lines 46 driven by a central feeder 48, attached to the derrick 42. The antenna 38 may detect electromagnetic waves radiated by a data transmission coupler 24 of a downhole tool 12. This signal may be transmitted to a receiver 16 or other surface equipment 16 by a transmission medium 60. As illustrated, the antenna 38 may maintain a relatively fixed position with respect to a downhole tool 12. In other embodiments, however, it is contemplated that the position of the antenna 38 could be adjusted relative to the structure 42 to adjust for variations in signal strength, alignment of the signal, and position of the open end of the downhole tool 12 and the like. In some embodiments, the antenna 38 may be positioned such that the signals emitted from the coupler may be received while the downhole tool 12 is moved, such as in a tripping operation. In some embodiments, a reflection mechanism may be used to reflect signals emitted from the coupler as the downhole tool 12 moves in relation to the antenna 38.

A dipole antenna or a series of dipole antennas may be advantageous on a drilling structures since equipment associated with drilling may make it difficult to place a full loop antenna in the desired range, such as on a off-shore drilling platform, semi-submersible derricks, or drill ships, where available space is limited.

The surface equipment 16 may include computers and analyzing equipment adapted to process the data received by the antenna. The antenna may communicate with the surface equipment 16 wirelessly through infrared waves or radio waves. In other embodiments, an electrically conducting cable may connect the antenna 38 to the equipment 16, such as a coaxial cable, triaxial cable, twisted pair of wires, copper wires, or combinations thereof. In other embodiment an optical cable may be desired such as on offshore platforms where the transmission medium 60 may be subjected to more moisture than on land operations.

Figure 5:
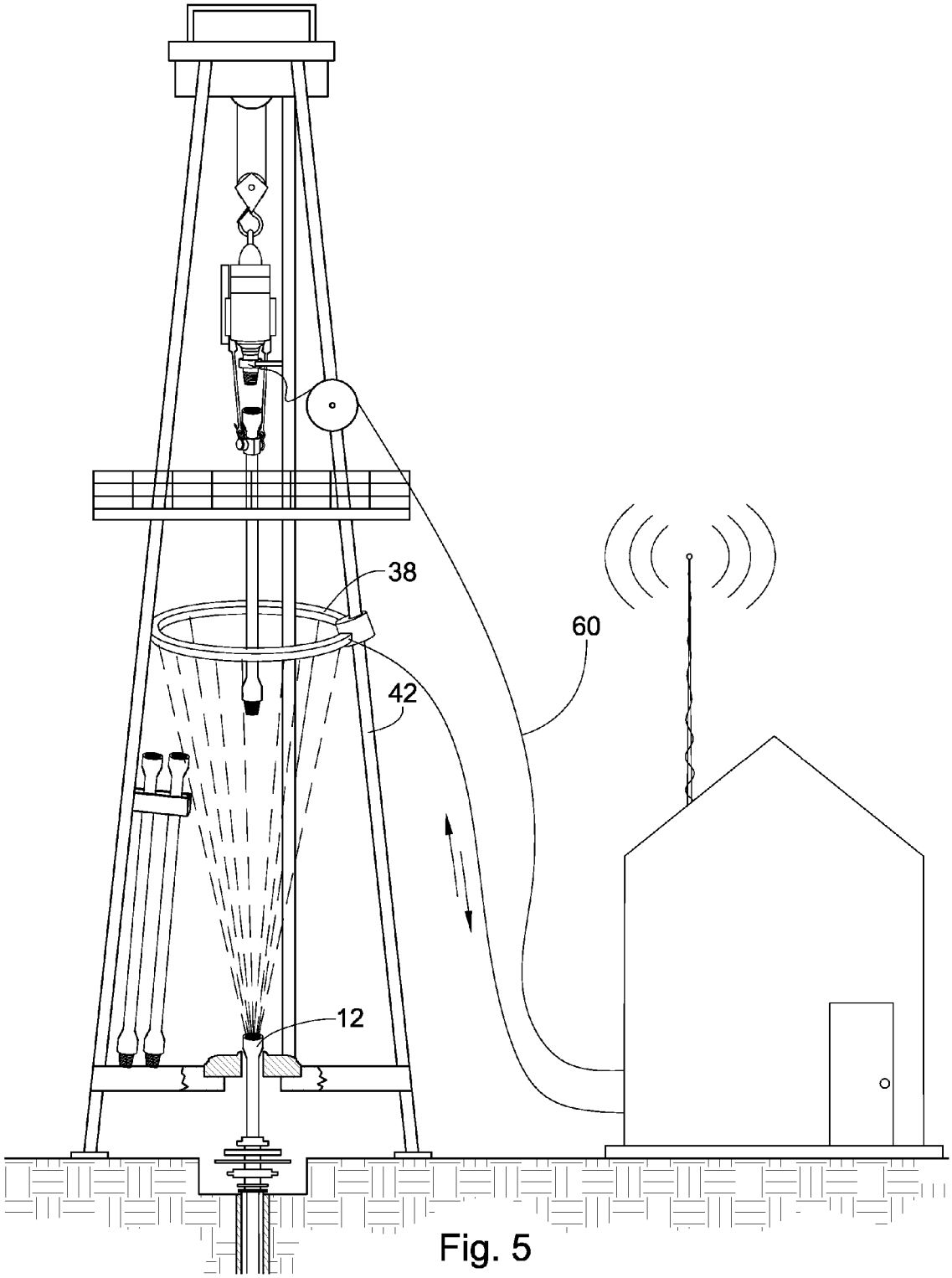
FIG. 5 is an elevation view of another embodiment of an antenna for wirelessly communicating with a data transmission coupler.

Referring to FIG. 5, in another embodiment, other types of antennas 38, such as a loop antenna 38 or magnetic loop antenna 38 may be attached to a structure 42, such as a derrick 42 or offshore platform. A loop antenna 38 shares similarities with a dipole antenna, except that ends of the dipole antenna may be connected to form a circle, triangle, square, or other closed loop. Because loop antennas typically radiate (and detect radiation) with greatest intensity in the plane of the loop, with nulls in the axis perpendicular to the plane of the loop, a loop may be oriented to account for these nulls.

In certain embodiments, the antenna 38, as well as the data transmission coupler 24, may function as a magnetic loop antenna. Unlike most other antennas types, this antenna detects the magnetic component of the electromagnetic wave. As a result, it is less sensitive to near field electric noise (i.e., noise within one wavelength of the antenna) when properly shielded. The receiving aperture can be increased by bringing the loop into resonance with a tuning capacitor.

Contrary to the large loop antenna discussed above, a magnetic loop antenna exhibits nulls in the plane of the loop. Its strongest signal is in a direction perpendicular to the plane of the loop. Consequently, this type of antenna may be particularly useful with the present invention since a loop formed by a data transmission coupler 24 may emit its strongest signal in the axial direction of the downhole tool 12 (i.e., in the direction perpendicular to the plane of the loop formed by the data transmission coupler 24 as shown in FIG. 2).

Figure 6:
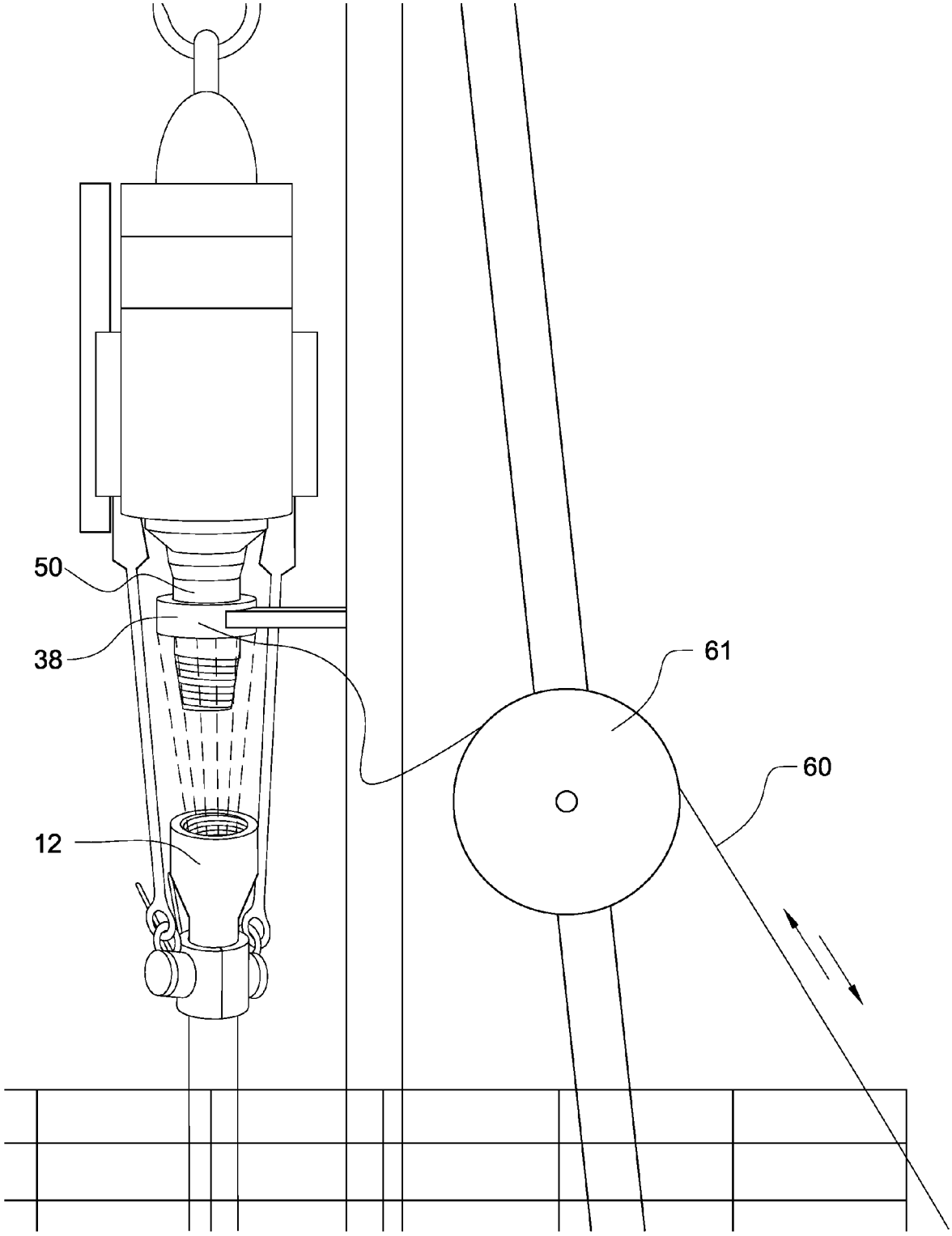
FIG. 6 is an elevation view of one embodiment of an antenna attached to or integrated with a swivel.

Referring to FIG. 6, in other embodiments, an antenna 38 may be attached to a moveable structure, such as a swivel 50. By attaching the antenna 38 to a swivel 50 or other moveable structure, such as a kelly, top drive, or hoist system, the antenna 38 may maintain a relatively fixed position with respect to a downhole tool 12 as the downhole tool 12 is raised or lowered. This may provide more reliable communication between the antenna 38 and the data transmission coupler 24 and help ensure the antenna 38 stays aligned with the downhole tool 12. In some embodiments a pulley 61 may be used to keep the transmission medium 61 out of the way of the drilling operation.

In certain embodiments, an antenna 38 mounted to a swivel 50 may work in conjunction with another antenna 38 mounted to a derrick 42 or other fixed structure 42, as illustrated in FIGS. 4 and 5. This may allow an antenna 38 mounted to a swivel 50 to communicate with the data transmission coupler 24 when the downhole tool 12 is connected to the drill string 10. However, when the downhole tool 12 raised by the swivel 50 is disconnected form the drill string 10, an antenna 38 mounted to the derrick 42 may then be used to communicate with the data transmission coupler 24 attached to the uppermost downhole tool of the drill string 10.

Figure 7:
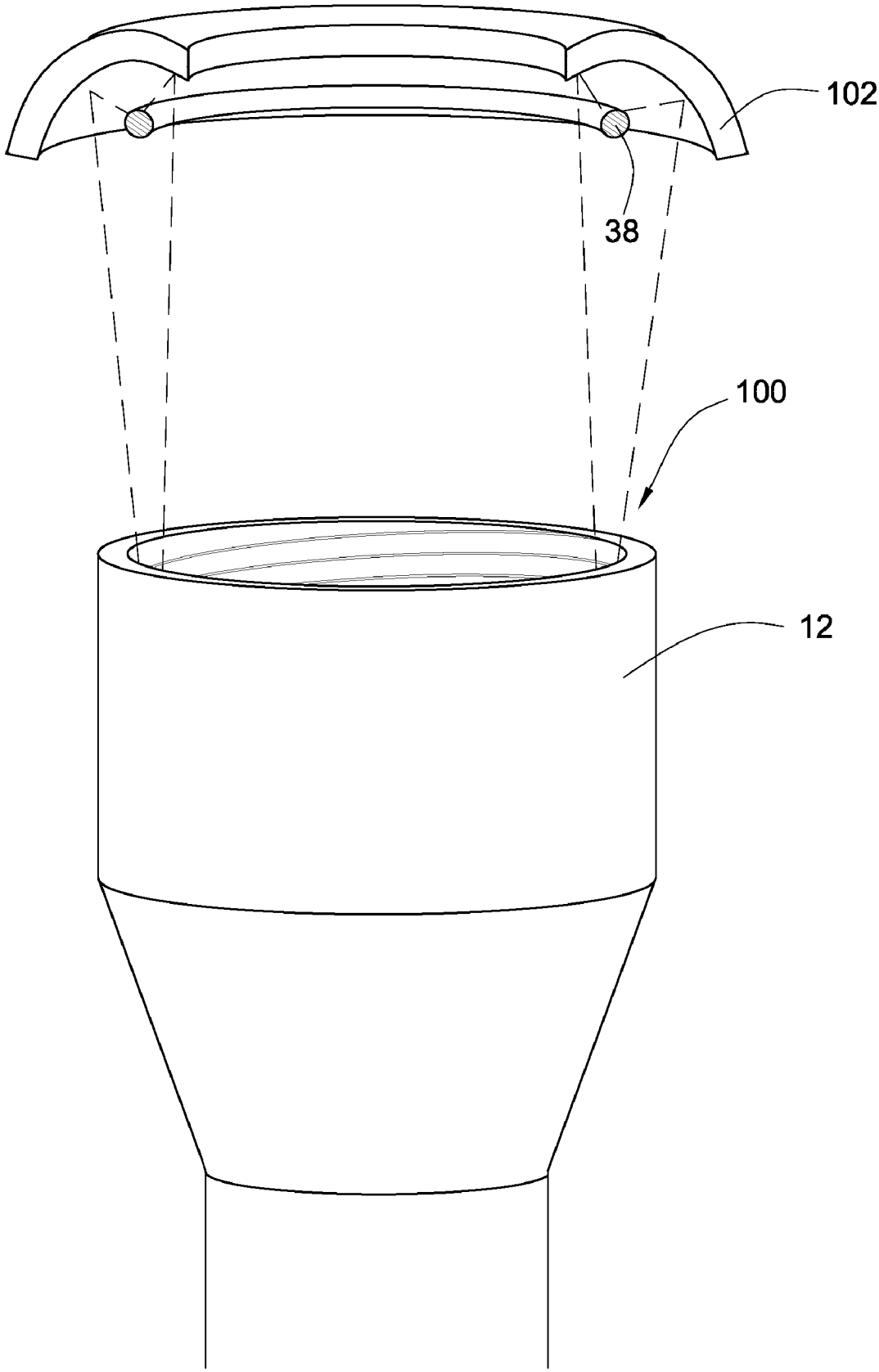
FIG. 7 is a perspective view of a reflection mechanism.

FIG. 7 discloses a reflection mechanism 102 which may be used with any of the aforementioned embodiments of the present invention. The radiation emitted from the coupler of the downhole tool 12 may only be able to leave the open end 100 at certain angles. If the antenna 38 is misaligned the reflection mechanism 102 may be used to direct the radiation towards the antenna 38. In some embodiments, the structure may be a drill ship or a semi-submersible drill rig which may be affected by the water's movement. In such embodiments, the antenna 38 may periodically become misaligned and the reflection mechanism 102 may enable continuous communication between the antenna and the coupler. In other embodiments, the drill ship may be positioned at a different roll or pitch than the downhole tool and the reflection mechanism 102 again may help compensate for the misalignment. In some embodiments, the reflection mechanism 102 may also serve a dual purpose of protecting the antenna from wind, rain, snow, hail, other conditions produced by weather, and/or drilling mud, which may drip off from downhole tools 12 hoisted above the antenna 38. In some embodiments, the antenna may be electrically isolated from the structure, such as the derrick, in case of lighting or other electrical sources that may come into contact with the structure.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

We claim:

1. A method for communicating with a downhole network integrated into a drill string, the method comprising:

halting rotation of a drill string, the drill string comprising a plurality of downhole tools equipped with data transmission couplers for transmitting data across the drill string tool joints;

exposing an uppermost data transmission coupler of the uppermost downhole tool of the drill string, and wirelessly communicating with the data transmission coupler, wherein the uppermost data transmission coupler is located in at least one of the primary shoulder, the secondary shoulder, and the threadform of the uppermost downhole tool.

2. The method of claim 1, wherein the uppermost data transmission coupler is selected from the group consisting of an inductive and a direct contact coupler.

3. The method of claim 1, wherein the uppermost data transmission coupler has a positive gain in the axial direction of the downhole tool.

4. The method of claim 1, wherein halting rotation further comprises at least one of tripping the drill string and halting rotation of the drill string in response to an emergency.

5. The method of claim 1, wherein wireless communicating comprises communicating with the uppermost data transmission coupler with an antenna located above ground level or above a rig floor.

6. The method of claim 5, further comprising mounting the antenna to at least one of a swivel, a derrick, a hoist system, and a kelly.

7. The method of claim 5, wherein the antenna is selected from the group consisting of a dipole antenna, a loop antenna, a magnetic loop antenna, and variations thereof.

8. The method of claim 5, wherein the antenna is positioned within about one foot to two hundred feet from the uppermost data transmission coupler.

9. The method of claim 5, wherein wirelessly communicating further comprises directing electromagnetic waves radiated by the uppermost data transmission coupler to the antenna.

* * * * *